US005871404A

United States Patent [19]

Weinreich

[11] Patent Number: 5,871,404

[45] Date of Patent: Feb. 16, 1999

[54] OPTICAL BLOB

[76] Inventor: Steve Weinreich, 14 Norton Rd., Monmouth Jct., N.J. 08852

[21] Appl. No.: 794,864

[22] Filed: Feb. 5, 1997

Related U.S. Application Data

[60] Provisional application No. 60/011,371 Feb. 9, 1996.

[51] Int. Cl.[6] ..... A63G 31/00

[52] U.S. Cl. ..... 472/63; 472/61

[58] Field of Search ..... 472/57, 58, 61, 472/63; 353/28, 37, 46, 50

[56] References Cited

U.S. PATENT DOCUMENTS

| | | | |
|---|---|---|---|
| 4,095,882 | 6/1978 | Karamon | 472/63 X |
| 4,814,956 | 3/1989 | Kano | 472/61 X |
| 4,971,312 | 11/1990 | Weinreich | 272/8 |

*Primary Examiner*—Kien T. Nguyen

[57] ABSTRACT

In an illusion apparatus for self viewing, a specific element (usually a dark region) of a display is positioned on or about the line connecting the viewer and the center of curvature of a partially reflective partially transparent, convex mirror. The specific element thus appears in a relatively constant relationship to the viewer's image even as the viewer changes position in relation to the mirror and display.

14 Claims, 5 Drawing Sheets

OPTICAL BLOB

This application claims priority of Provisional patent application Ser. No. 60/011,371 filed on Feb. 9, 1996.

BACKGROUND OF THE INVENTION

The Optical Blob is related to my previous inventions, Illusion Apparatus, U.S. Pat. No. 4,971,312 and "Training Video Method and Display, U.S. Pat. No. 5,681,223"both incorporated herein by reference.

The Illusion Apparatus patent describes a diorama or display image comprising a darkened area. The image of a viewer of the diorama or display is inserted into the darkened area.

The co-pending patent discloses a means to provide a higher quality composite image. The co-pending patent also discloses a preferred method, using electronics, to move a darkened area about the display in response to the motion of the viewer.

It is also possible to move the darkened area about the display in response to signals from the previously disclosed switch mat or by other means such as a difference key or the infra-red key described in the co-pending patent. Where the display is not an electronic display, a dark mask or dark object may be moved about the display by motors in response to position signals as mentioned above or by purely mechanical linkage to the viewer.

The above methods may be expensive and/or inconvenient. It is the primary purpose of the present invention to move a darkened area, or blob, about the display, in response to the motion of the viewer, by purely optical means. In each embodiment, the viewer perceives his or her image in relation to a specific part (usually a dark region) of the display which, without moving parts, matches the position of the viewer's image.

OUTLINE OF THE INVENTION

The invention takes advantage of the fact that, for the preferred spherical mirror (and, within reasonable tolerances, mirrors of other shapes) there is a center of curvature. The viewer's image always falls on the line between the viewer and the center of curvature (as may be readily seen from basic optical principles).

In the invention, a specific element (usually a dark region) of the display is positioned on the viewer-to-center-of-curvature line, preferably at or about the center of curvature. The specific element thus appears in a relatively constant relationship to the viewer's image even as the viewer changes position in relation to the mirror and display.

Sometimes it is impractical to position the specific element of the display at the mirror's center of curvature. For a video image, e.g., the mirror's center of curvature is typically inside the TV tube. Such situations are accommodated in the invention by moving the specific element (preferably a dark area) to another position on the viewer-to-center-of-curvature line.

A corollary of the above (that the viewer's image always falls on the line between the viewer and the center of curvature) is that the viewer always sees his or her image only in that portion of the preferably spherical mirror which is nearly perpendicular to the viewer-to-center-of-curvature line. The specific element is made to appear on the viewer-to-center-of-curvature line even as the viewer changes position by, in effect, recreating the specific element for each viewer position. In some embodiments of the invention, the specific element (preferably a dark region) exists as an interference between a pair of patterns. The patterns are spaced such that the interference is only apparent when viewed perpendicular to the mirror. The specific element thus appears in a relatively constant relationship to the viewer's image even as the viewer changes position in relation to the mirror and display.

DRAWINGS

The figures are plan views (from above) in order to clearly show the relationships between elements of each embodiment shown. Viewer images shown are not actually visible from this vantage point, but are positioned to show the locations where they appear to the viewer.

OPERATION OF THE PREFERRED EMBODIMENTS

Figure 1:
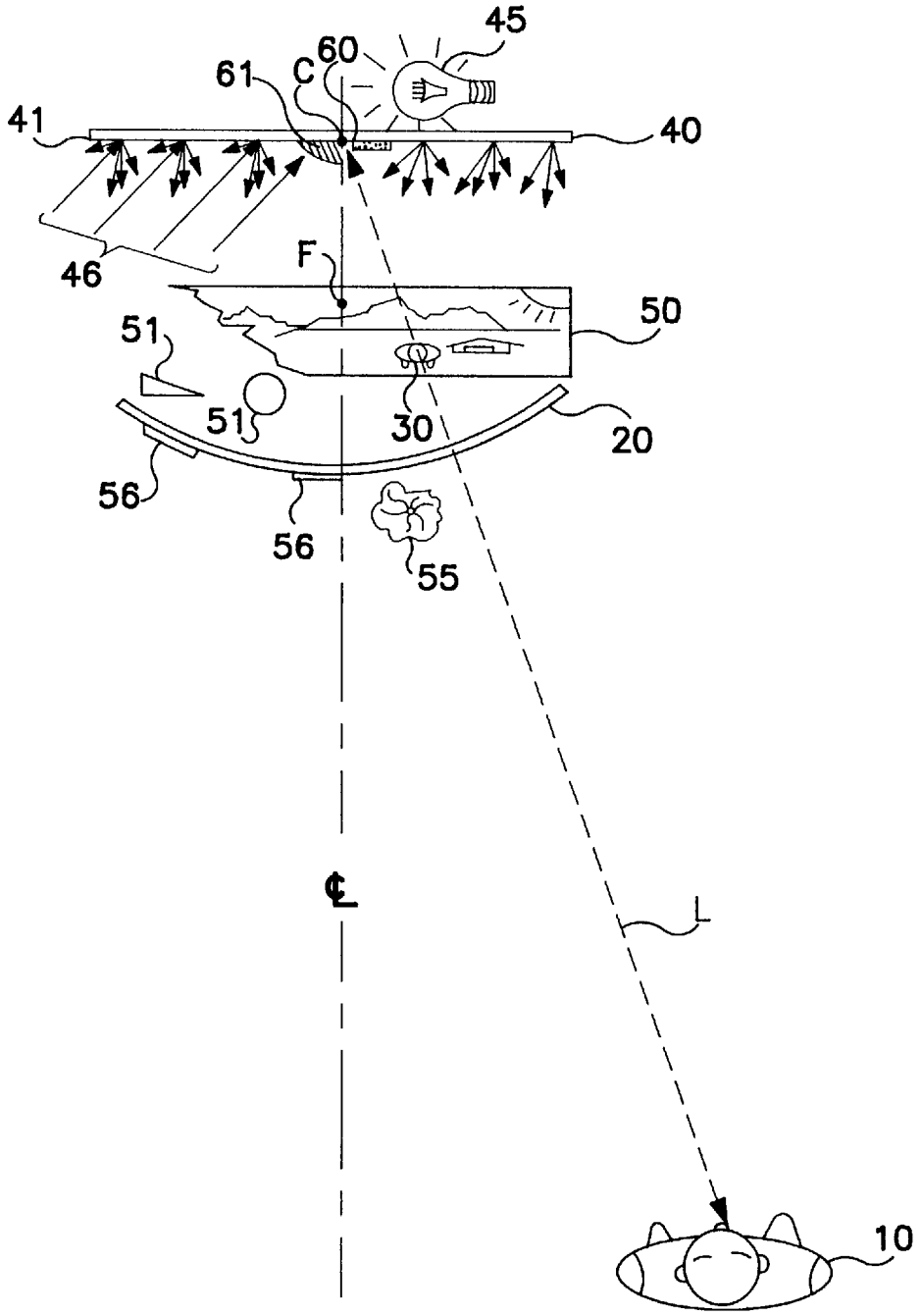
FIG. 1 shows an embodiment of the invention comprising dark display elements placed at or near the center of curvature of the mirror and a transparent scene through which the viewer's image can move.

A FIRST EMBODIMENT, shown in FIG. 1, is applicable where the display can comprise a transparency or a diorama of transparent elements.

In this embodiment, the display is lit by artificial light 45 or natural light 46 from the front or rear. If lit from the rear, light passes through, preferably, a plastic diffuser sheet 40. From the front, the light strikes a preferably diffuse white surface 41. Diffuser 40 or 41 is preferably placed at or beyond the center of curvature C of a partially reflective and partially transparent convex mirror 20.

A dark mask 60 or dark object 61 is positioned proximate to the center of curvature C of mirror 20. Where diffuser 40 or 41 is at the plane of the center of curvature C, a mask 60 may be painted onto or otherwise placed on the diffuser 40 or 41 surface.

A transparency 50, preferably of a scene, is mounted preferably between mirror 20 and the focus F of mirror 20 and is preferably tilted (the top of transparency 50 away from viewer 10). Thus the foreground of the scene, usually at the bottom, is closer to mirror 20.

Instead of or in addition to transparency 50, transparent objects 51 may be placed in the scene.

Additional foreground objects 55 and 56 may be added which should be lit internally or from the front. These need not be transparent and are preferably not transparent. They may be in front of mirror 20. Viewer's image 30, as discussed above, falls on the line L between viewer 10 and the center of curvature C of mirror 20. Therefore, light from diffuser 40 or 41 will always be blocked by mask 60 or dark object 61 in that part of transparent scene 50 or 51 where viewer's image 30 falls. Viewer's image 30 will thereby be clearly visible to viewer 10 from any vantage point.

Any additional non-transparent, lighted foreground objects 55 or 56 (see above) will wash out viewer's image 30 so that viewer's image 30 will pass behind them without ambiguity.

It should be noted that some deviation from pure transparency (i.e., with some diffusion) will not be detrimental to the illusion as disclosed. The terms "transparent" and "transparency" include such variations.

Figure 2:
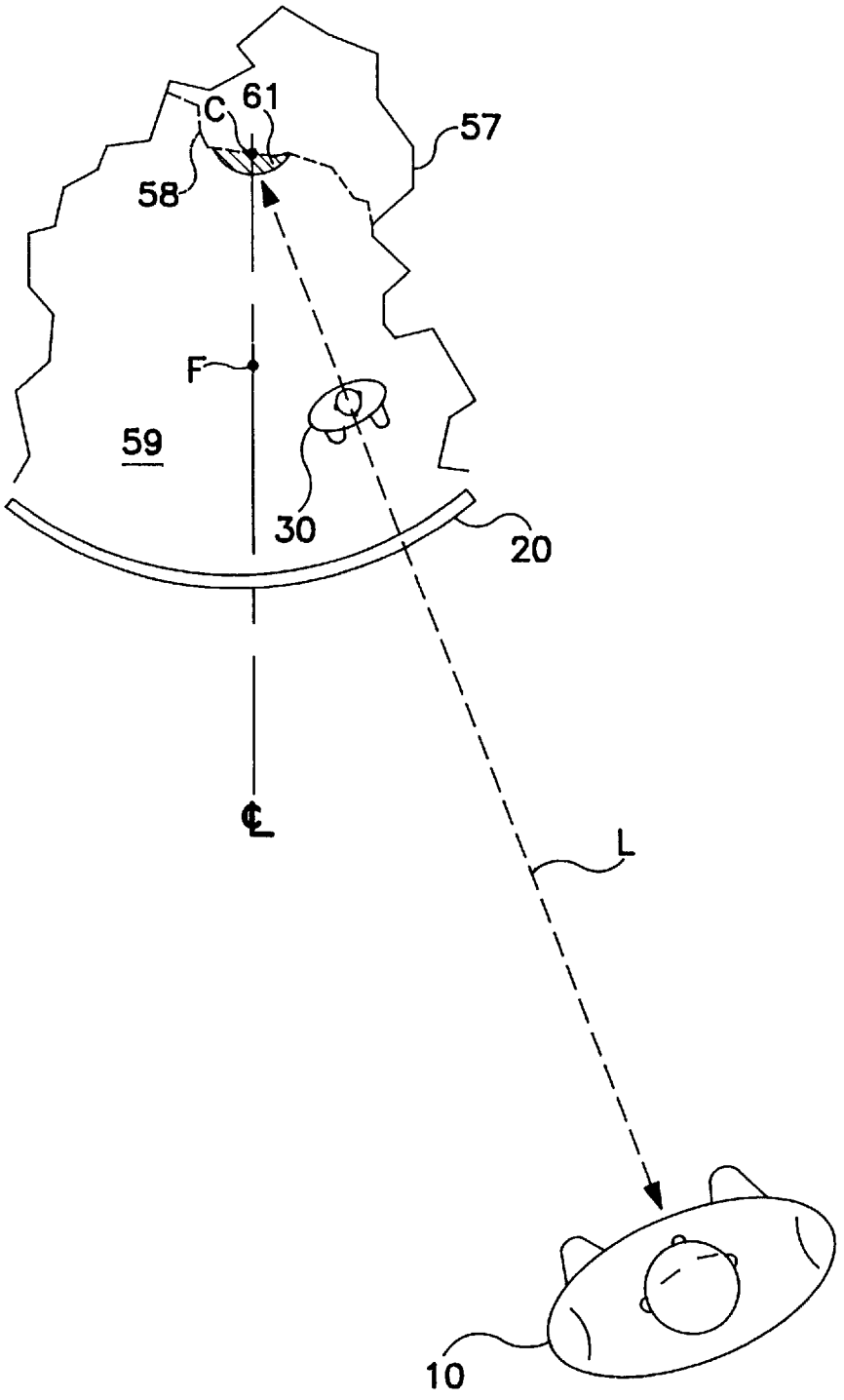
FIG. 2 shows an embodiment comprising a dark display element at or near the center of curvature of the mirror and a diorama.

A SECOND EMBODIMENT, shown in FIG. 2, places a dark object 61 at or near the center of curvature C of a partially reflective and partially transparent convex mirror 20. A diorama 57 is constructed to allow a viewer 10 a relatively unobstructed view through mirror 20 to dark object 61 at center of curvature C. An alternate diorama back wall 58 is roughly coincident with center of curvature C, allowing dark object 61 to be painted on wall 58.

To viewer 10, viewer's image 30 will always fall against a dark background.

To better accommodate viewer's image 30, diorama 57 preferably has a dark floor 59 (and/or ceiling) in that area against which image 30 may fall. This is often a large portion of the floor 59 area.

Diorama 57 can be illuminated by ordinary means so that the floor 59 is relatively in shadow. A transparency 50 and illumination arrangement (40/41, 45/46, and 60/61) of the first embodiment (above) can be used as the floor 59 of diorama 57. In that way, the floor 59 of diorama 57 is only dark in that region occupied center of curvature C, may have to extend substantially below the floor 59 (and/or above the ceiling) of diorama 57 in order to accommodate the possible viewing angles.

Figure 3:
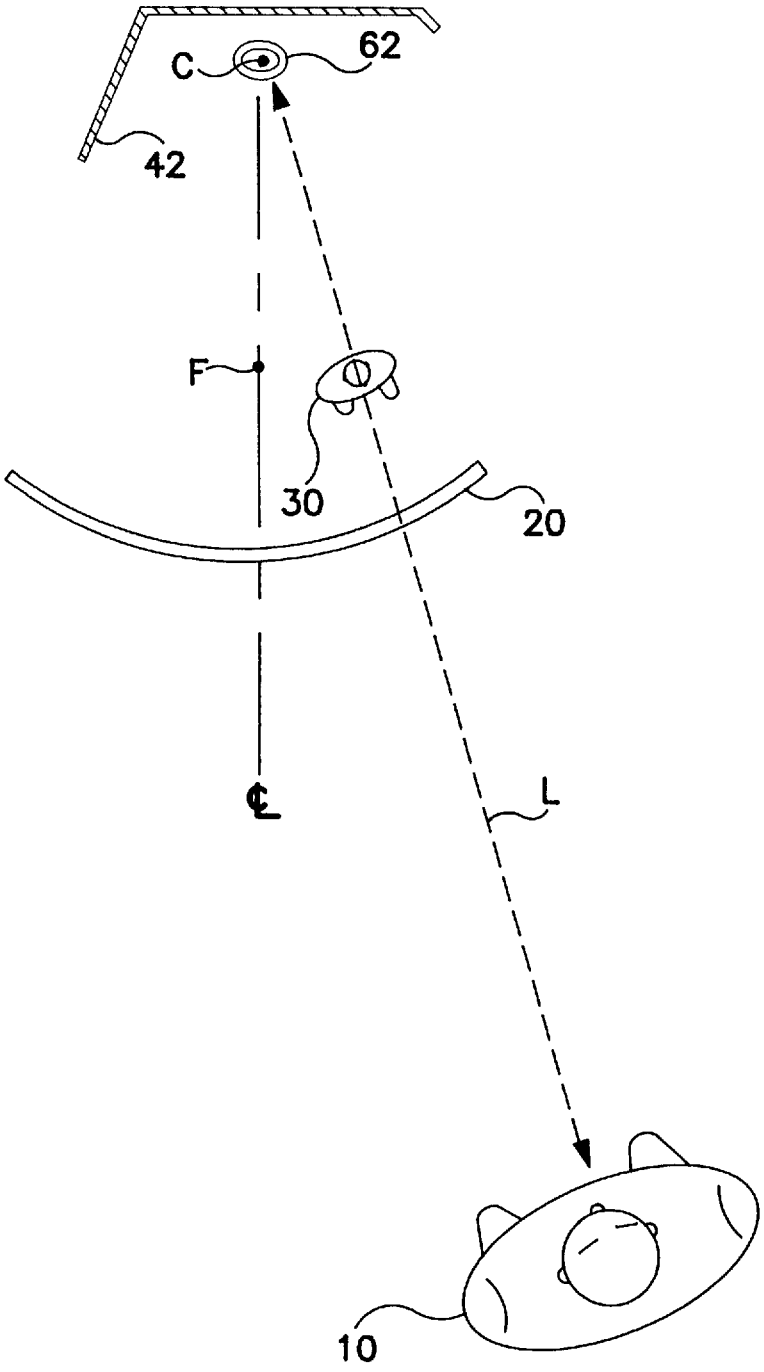
FIG. 3 shows an embodiment of the invention comprising a bright display element at or near the center of curvature of the mirror.

A THIRD EMBODIMENT, shown in FIG. 3, places a preferably relatively brightly lit image or object 62 at or near the plane of the center of curvature C of a partially reflective and partially transparent convex mirror 20. Image or object 62 is preferably in front of a dark background 42. In use, the brightly lit image or object 62 will appear to a viewer 10 to follow the viewer's image 30 about. Thus, a brightly lit halo 62, for example, may appear above the head of viewer's image 30 regardless of viewer 10's position or movement (or an angel or devil may sit on the viewer's shoulder).

Although viewer's image 30 is actually substantially closer to mirror 20 than is the bright image or object 62, an acceptable illusion is created.

Figures 4A, 4B, 4C:
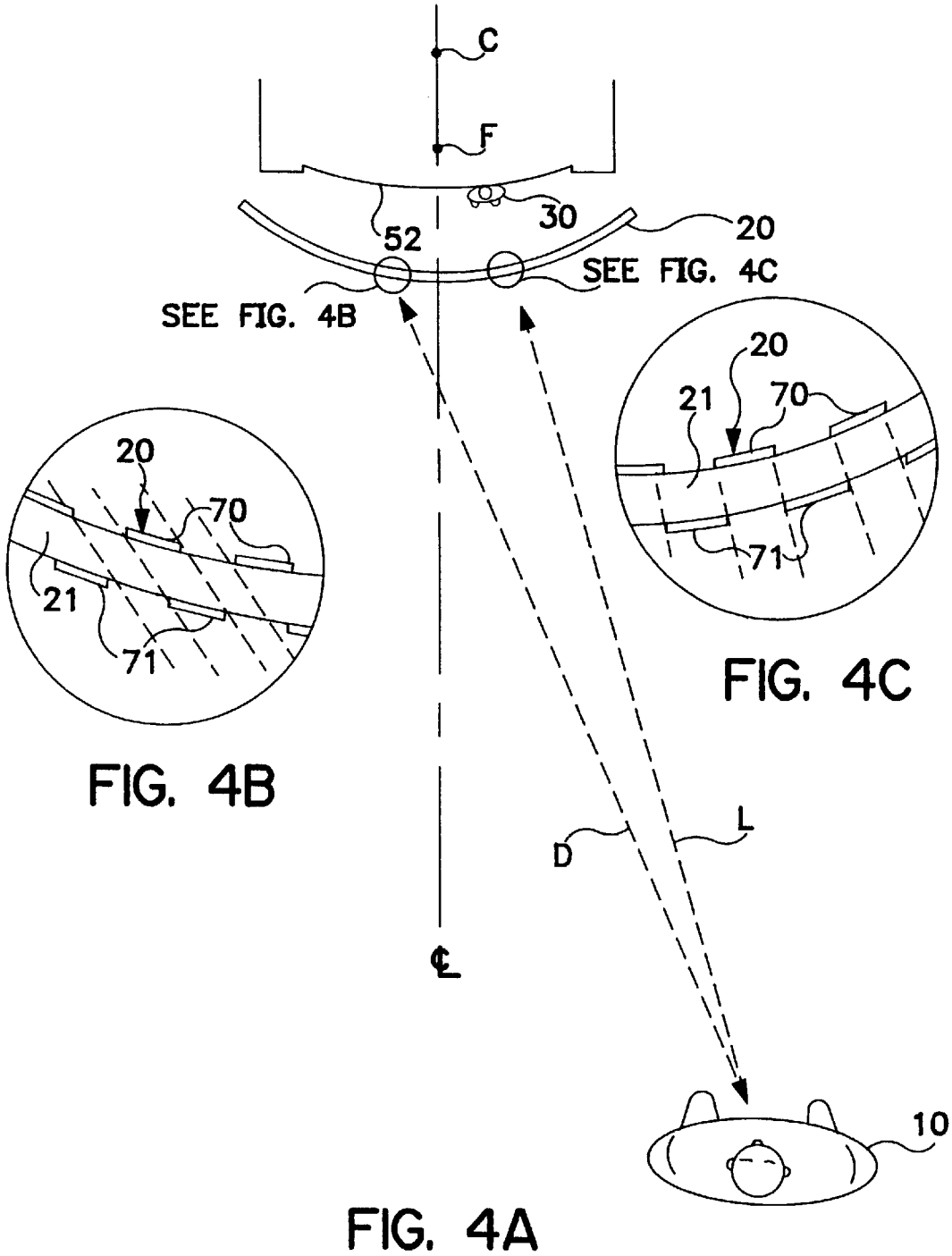
FIG. 4A, shows an embodiment of the invention comprising interfering screen patterns and a video or computer display.
FIGS. 4B and 4C are details showing the screen patterns of the embodiment shown in FIG. 4A.

A FOURTH EMBODIMENT, shown in FIG. 4, darkens the appropriate area of a video or computer display 52 by the placement of preferably two, preferably concentric, preferably spherical screens 70 and 71. Display 52 is preferably placed at or about the position where a viewer's image 30 will fall. Screens 70 and 71 are separated such that the pattern of the first screen 70 registers with the voids of the second screen 71 when viewed via a normal to the surfaces of the screens. This normal is also the viewer-to-center-of-curvature line L.

A viewer 10, will view his or her own image 30 via line L which will everywhere be perpendicular to a partially reflective and partially transparent mirror 20. Along line L, the screen patterns 70 and 71 will overlap to obscure video or computer display 52 from viewer 10, thus allowing viewer 10 to clearly see viewer's image 30.

A different line of view D will allow viewer 10 to see display 52 through voids in screen patterns 70 and 71. Display 52 will (as taught in the Illusion Apparatus patent) obscure reflections of the viewer 10's environment.

It is preferred that the screen pattern elements be small enough that the screen patterns are not apparent to viewer 10 using the apparatus. It is also preferred that screens 70 and 71 be applied on the two surfaces of mirror 20, in which case the mirror substrate 21 should be of an appropriate thickness to properly space the screens 70 and 71 one from the other. Conversely, the size of the screen elements can be based on a preferred thickness for the mirror substrate 21.

It is preferred (particularly for economy) that screen patterns 70 and 71 be black and opaque. These patterns can be applied by any ordinary means, such as silk screen or stencil. It is also possible to use reflective or partially reflective screen patterns such as may be applied by selective vacuum deposition or selective removal of previously deposited reflective material (such as aluminum) or by transfer from patterned roll leaf. If a reflective pattern is used, it is preferred that only one of the two patterns be reflective to avoid a double image. With the use of a reflective pattern, the substrate need not necessarily have other reflective deposition.

The patterns may be applied before or after the substrate is formed. Although applying patterns to a flat substrate is easier, care must be taken to limit distortion during forming so that patterns are not overly out of register after forming. Pre-distortion of the patterns can help offset the effects of forming.

The patterns are preferably a closely spaced field of vertically oriented oval dots and vertically oriented oval holes. With this structure, the screens will become transparent more rapidly in the horizontal direction (since the screen spacing is constant). The darkened area will thus have a greater extent in the vertical direction to better accommodate the viewer's image. The screens may also be offset vertically (lowering the inside screen 70) so the darkened area will extend further below eye level than above. Variations which allow control over the shape and extent of the darkened area include adjustment of the registration of the screens, varying the proportion of each dot to its associated hole, varying the shape of the dots, varying the density of each screen element across its area, and varying the dot and/or hole pattern(s) over the screen area. The results of screen design variations can be determined by ordinary geometrical analysis.

Figure 5:
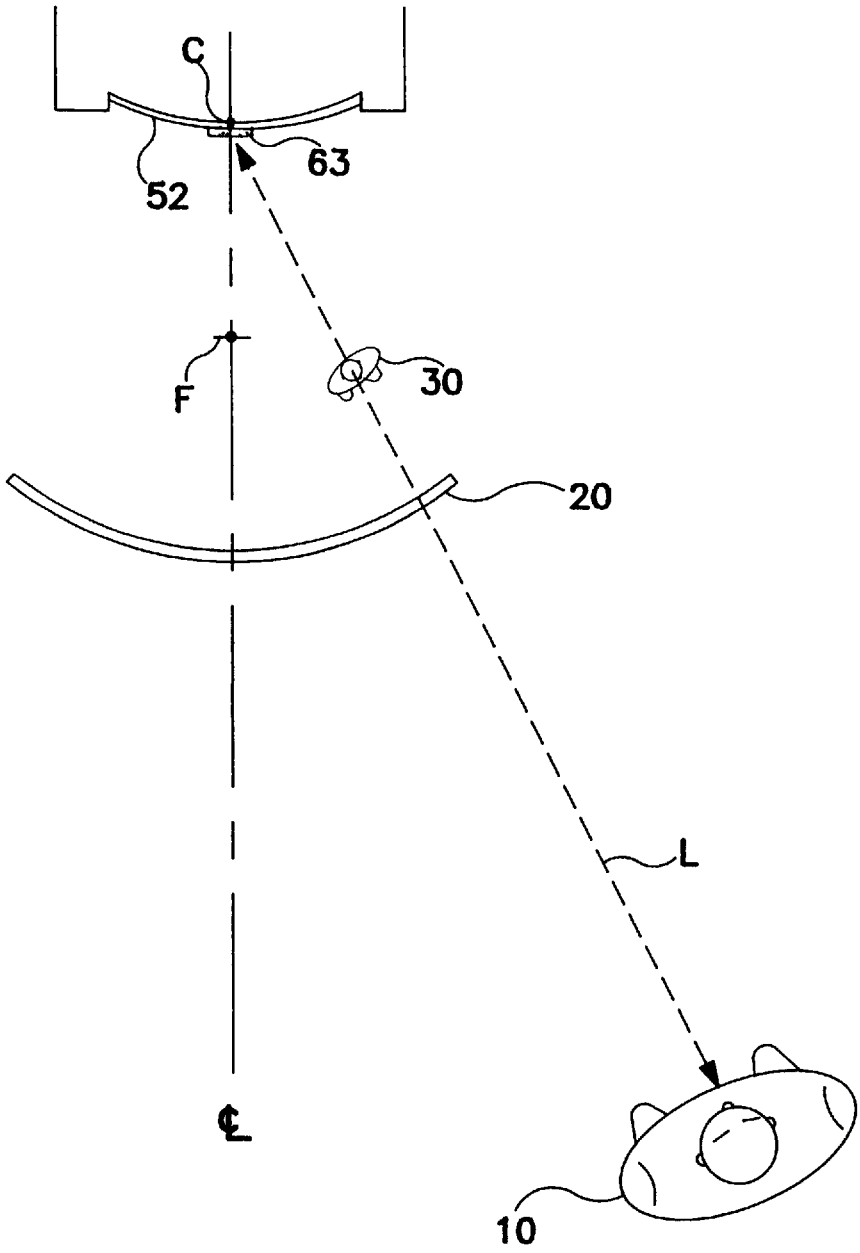
FIG. 5 shows an embodiment of the invention comprising a video or computer display near the plane of the mirror's center of curvature and a dark area in (or on) the display.

A FIFTH EMBODIMENT, shown in FIG. 5, takes advantage of the ambiguity in image position as in the THIRD EMBODIMENT above.

In this embodiment, a video or computer display 52 is placed at or near the plane of the center of curvature C of a partially reflective and partially transparent mirror 20. A dark area 63 of display 52 (or on display 52) coincides with center of curvature C.

Thus, dark area 63 will, to a viewer 10, back up the viewer's image 30 regardless of the position of viewer 10. This embodiment may be inferior to some other embodiments in creating a composite image, since the display 52 and viewer's image 30 are in different planes. It can, however, be effective as, e.g. a backwall or background with elements of other embodiments.

This embodiment, like the THIRD EMBODIMENT, can also effect the illusion that a bright object is following the viewer's image (or dancing around the viewer's image).

For each embodiment, the preferred illusion works for each viewer only in relation to that viewer's own image. In the dark region embodiments, each viewer will see clearly only his or her own image. The brightly lit halo will appear only over each viewer's own head.

While the invention has been described with reference to preferred embodiments thereof, it will be appreciated by those of ordinary skill in the art that various modifications can be made to the structure and operation of the invention without departing from the spirit and scope of the invention as a whole.

I claim:

1. An illusion apparatus for self viewing comprising:

a partially reflective, partially transparent, convex mirror, disposed to produce an image of a viewer of the apparatus, the image being visible to the viewer;

a display, the display comprising a specific display element; and the specific display element, disposed to appear to a randomly positioned viewer on or about a line passing through the viewer and the center of curvature of the mirror, whereby the specific display element appears to the viewer to follow the viewer's image in said mirror.

2. The apparatus of claim 1, wherein the specific display element is a relatively dark region.

3. The apparatus of claim 1, wherein the specific display element is a relatively brightly lit image or object.

4. The apparatus of claim 1, wherein the specific display element is positioned at or near the center of curvature of the mirror.

5. The apparatus of claim 4, also comprising:

a diffuser, positioned at or near the center of curvature of the mirror; and a light source, disposed to illuminate the diffuser, whereby natural and/or artificial light from the light source is diffused.

6. The apparatus of claim 5, also comprising:

a transparency, positioned between the mirror and the diffuser.

7. The apparatus of claim 5, also comprising:

transparent objects, positioned between the mirror and the diffuser.

8. The apparatus of claim 5, also comprising:

non-transparent display elements, as foreground.

9. The apparatus of claim 4, also comprising:

a diorama, constructed to allow a viewer of the apparatus a relatively unobstructed view through the mirror to the specific display element.

10. The apparatus of claim 4, wherein the display is a video or computer display positioned proximate to the center of curvature of the mirror.

11. The apparatus of claim 1, also comprising:

at least two screen patterns, the screen patterns being spaced apart such that they will interfere with one another when viewed perpendicularly.

12. The apparatus of claim 11, wherein the screen patterns are concentric.

13. The apparatus of claim 11, wherein the screen patterns are applied to the surfaces of the mirror.

14. The apparatus of claim 11, wherein the display is a video or computer display.

* * * * *